US006450850B1

(12) United States Patent
Nunomura

(10) Patent No.: US 6,450,850 B1
(45) Date of Patent: Sep. 17, 2002

(54) METHOD OF MANUFACTURING DISPLAY PANEL AND DISPLAY DEVICE

(75) Inventor: Keiji Nunomura, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/487,068

(22) Filed: Jan. 19, 2000

(30) Foreign Application Priority Data

Jan. 22, 1999 (JP) ..... 11-014844

(51) Int. Cl.[7] ..... H01J 9/24
(52) U.S. Cl. ..... 445/24
(58) Field of Search ..... 445/24; 313/582, 313/385

(56) References Cited

U.S. PATENT DOCUMENTS 5,853,446 A * 12/1998 Carre et al. ..... 445/24
5,992,320 A * 11/1999 Kosaka et al. ..... 313/582
6,199,404 B1 * 3/2001 Kawai et al. ..... 65/102

FOREIGN PATENT DOCUMENTS

| | | |
|---|---|---|
| JP | 53-28373 | 3/1978 |
| JP | 7-161298 | 6/1995 |
| JP | 9-12336 | 1/1997 |
| JP | 9-69335 | 3/1997 |
| JP | 9-134676 | 5/1997 |
| JP | 9-283017 | 10/1997 |
| JP | 10-101373 | 4/1998 |
| JP | 11-297195 | 10/1999 |

* cited by examiner

*Primary Examiner*—Kenneth J. Ramsey
(74) *Attorney, Agent, or Firm*—Hutchins, Wheeler & Dittmar

(57) ABSTRACT

In a display panel manufacturing method and a display device manufactured by the method, a plate-shaped partition wall-forming member is sandwiched between a mold having an inverted shape to partition walls and a support mold to press-mold the partition wall-forming member therebetween, thereby forming a partition wall member comprising partition wall portions and a bottom insulating layer portion while coming into close contact with the mold. Thereafter, the partition wall member is transferred onto a display substrate to complete a display panel.

9 Claims, 6 Drawing Sheets

METHOD OF MANUFACTURING DISPLAY PANEL AND DISPLAY DEVICE

BACKGROUND OF THE INVENTION

1. Field of the Invention

The present invention relates to a display panel manufacturing method and a display device and particularly, to a display panel manufacturing method and a display device which are suitably applied to a plasma display for use in a flat type television, an information display device, or the like.

2. Description of the Prior Art

A plasma display device is a display device of such a type that ultraviolet rays are generated by gas discharge and phosphor is excited by the ultraviolet rays thus generated to emit light, thereby achieving a display, and it has been expected to be applied to a large-screen television, an information display device, or the like. Various systems have been developed for color plasma displays, and an AC surface discharge type plasma display device is excellent in brightness and easy manufacturing of panels among these systems.

FIG. 1 shows the conventional construction of a representative reflection type-AC surface discharge color plasma display panel.

The panel comprises back substrate 100 and front substrate 200. The back substrate 100 comprises glass substrate 1; belt-shaped data electrodes 2, bottom dielectric layer 3 and partition walls (bulkheads) 4, which are formed on the glass substrate 1; and red, green and blue phosphors 5 which are coated on the bottom portions and side surfaces of grooves formed between the partition walls 4. The front substrate 200 comprises glass substrate 6, and surface discharge electrodes 7, transparent dielectric layer 8 and protection layer 9 which are formed on the glass substrate 6. The front substrate 200 and the back substrate 100 are faced each other, and they are frit-sealed at the peripheral portion of the panel. The assembly thus frit-sealed is subjected to vacuum exhausting and heating, and then it is hermetically filled with gas, thereby completing the panel. The bottom dielectric layer 3 is not necessarily required, and the partition walls 4 and the phosphors 5 may be formed after the data electrodes 2 are formed.

As shown in FIG. 1, the typical partition walls 4 are designed in a stripe structure so that they extend vertically to the extension direction of the surface discharge electrodes 7 and in parallel to the extension direction of the data electrodes 2 and are arranged along the direction parallel to the extension direction of the data electrodes 2. The partition walls 4 serve to ensure the discharge space and also to prevent cross-talk of discharge and mixture of emitted light colors between adjacent cells, and they are important constituent elements for the plasma display panel.

In general, the partition walls 4 are designed at a height of about 100 to 150 $\mu$m and at a width of about several tens $\mu$m, and they may be formed by various forming methods. For example, there are practically used a method of repeating screen-printing and baking of dielectric paste for the partition walls 4 until the height of the dielectric paste thus screen-printed and baked is equal to a predetermined value; a method of coating and drying a dielectric paste of predetermined thickness, patterning the surface of the dielectric paste layer by using a photosensitive resist and then sandblasting the dielectric paste layer; and an additive method of forming a pattern of grooves on a photosensitive resist, coating and drying a paste for partition walls in the grooves and then removing the photosensitive resist.

However, in the case of the screen-printing method, it is difficult to keep high precision over the panel, because the precision of a screen plate is low and the plate itself is deformed. In addition, since the printing and drying operation must be repeated at about 10 times for example, it takes a long time to manufacture the partition walls 4, and the screen plate itself is severely wasted. Therefore, it is difficult to manufacture large-area and fine partition walls at a low cost. In the case of the sandblast method, although the manufacturing precision is high, because the patterning of the partition walls is performed by using a photography technique, the number of manufacturing steps is large and many materials are wasted, thus resulting in increase in manufacturing cost. In addition, it is relatively difficult to control the sectional shape of the partition walls. In the case of the additive method, the number of manufacturing steps is also large, which causes increase in manufacturing cost. In addition, it is difficult to manufacture high-aspect partition walls each having a narrow width.

Besides, there have been proposed methods of directly forming partition walls by using a mold unlike the above methods. For example, in Japanese Laid-open Patent Publication No. 9-134676, fluid partition wall member 11 composed of low melting-point glass, filler, binder, or the like is filled into recess portions for making partition wall portions formed in mold 20 by using a doctor blade method or the like (FIG. 2A). Substrate 10 is pressed against the mold 20 filled with the fluid partition wall member 11, and the fluid partition wall member 11 is hardened by heating or irradiation of ultraviolet rays to join the fluid partition wall member 11 and the substrate 10 into one body and then baked, thereby forming partition walls on the substrate 10 (FIG. 2B).

In Japanese Laid-open Patent Publication No. 9-283017, partition wall member 11 composed of low melting-point glass, filler, binder, solvent, or the like is coated on substrate 10 (FIG. 3A), and then mold 20 having recess portions formed therein is pressed against the substrate 10 coated with the partition wall member 11 to press-mold the partition wall member 11 in the recess portions of the mold 20 (FIG. 3B). After the mold 20 is separated, the partition wall member 11 is baked to form the partition walls on the substrate 10 (FIG. 3C). Further, As the other example, roll-shaped mold is used as the mold 20 and it is rolled on the substrate 10 coated with the partition wall member 11 to form partition wall-shaped partition wall member 11 on the substrate 10.

As to these methods using the mold, it is expected that the number of manufacturing steps is more reduced as compared wit the sandblast method, etc. and at least the shape of the partition wall member before the baking step can be obtained with the precision of the mold. However, industrial use of these methods has not yet been advanced at the present situation. That is, in practical use, the conventional methods using the molds have various disadvantages that much time is needed to cure the member filled in the mold, it is required to keep the substrate at high temperature while the substrate is brought into contact with the partition wall member and pressurized and it is impossible to perfectly separate the mold from the partition wall member, because the adhesion strength between the substrate and the partition wall portions cannot be sufficiently enhanced.

SUMMARY OF THE INVENTION

A display panel manufacturing method comprises: a step of sandwiching a plate-shaped partition wall-forming member between a mold having an inverted shape to partition walls and a counter (support) mold, and press-molding the partition wall-forming member to form a partition wall member comprising partition wall portions and a bottom insulating layer portion in close contact with the mold; and a step of transferring the partition wall member onto a display substrate.

A display device according to the present invention is manufactured by the display panel manufacturing method of the present invention.

The present invention is suitably applied to an AC discharge type plasma display device, however, it may be applied to various display devices using other partition walls. For example, it may be applied to display devices such as FED (Field Emission Display) for emitting electrons from a cold cathode electrode source to excite phosphor, PALC (Plasma address Liquid Crystal Display) for controlling liquid crystal by using a plasma switch, VFD (Vacuum Fluorescent Display) for exciting phosphor by using low-speed electron beams, or the like. Further, the present invention is not limited to the AC discharge type plasma display, but it may be applied to a DC (Direct Current) discharge type plasma display. In the case of the AC discharge type plasma display, the electrodes are covered by the bottom insulating layer. However, in the case of such a display device that the electrodes and the phosphor are exposed to the space, the electrodes and the phosphor may be formed on the bottom insulating layer.

DETAILED DESCRIPTION OF THE PREFERRED EMBODIMENTS

Preferred embodiments according to the present invention will be described hereunder with reference to the accompanying drawings.

Figure 1:
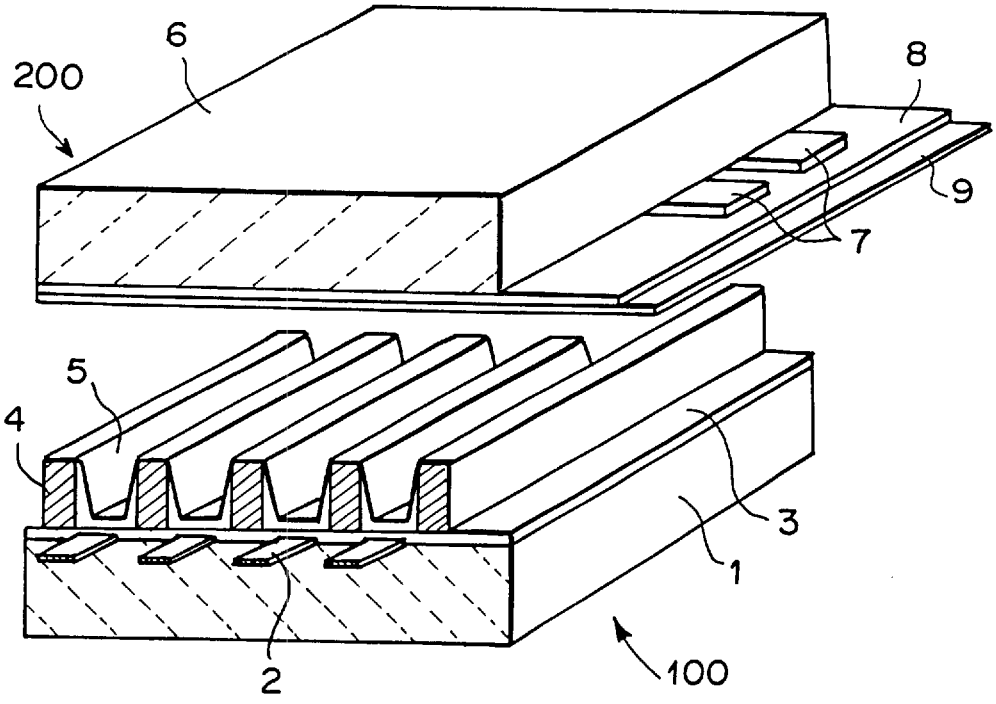
FIG.1 (PRIOR ART)
FIG. 1 is a diagram showing the structure of a color plasma display.
Figure 2A:
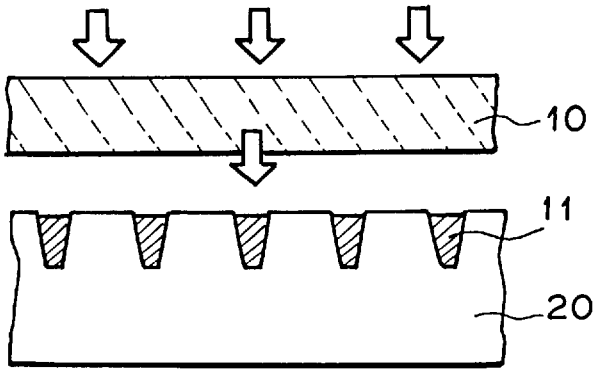
FIG.2A (PRIOR ART)
FIGS. 2A and 2B are diagrams showing a conventional method of manufacturing partition walls.
Figure 2B:
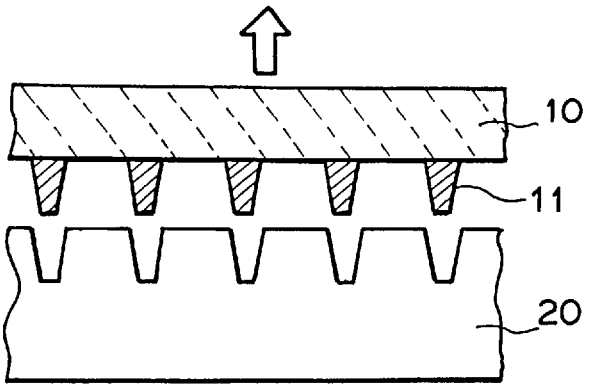
FIG.2B (PRIOR ART)

In the first embodiment, the basic step of the partition wall manufacturing method which is the fundamental step of the present invention will be described. Further, in the second to fourth embodiments, methods for more surely manufacturing the partition walls of the present invention will be described. In the following description, the partition wall manufacturing methods described above are applied to the plasma display device described with reference to FIG. 1.

(First Embodiment)

FIGS. 4A to 4F show an embodiment of the partition wall manufacturing method of the present invention.

Figure 4A:
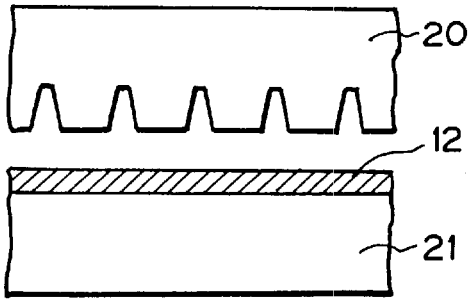
FIGS. 4A to 4F are diagrams showing a method of manufacturing partition walls according to a first embodiment of the present invention.
Figure 4B:
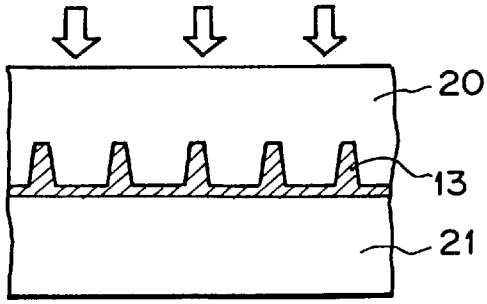

First, slurry containing filler of aluminum oxide powder or the like, low melting-point glass powder, binder, solvent, and the like is coated at a predetermined thickness on a carrier film such as a polymer film by a doctor blade method and then dried to form a plate-shaped green sheet 12 serving as a partition wall-forming member. The green sheet 12 thus formed is set on table 21 of a pressure device (FIG. 4A). Subsequently, mold 20 having many stripe-shaped grooves formed thereon is put on the green sheet 12 to pressurize the green sheet 12 while the green sheet 12 is sandwiched between the mold 20 and the table 21, thereby press-molding green sheet 13 serving as a partition wall member which is formed under pressure so as to contains the partition wall portions and the bottom dielectric layer portion (bottom insulating layer portion).

Figure 4C:
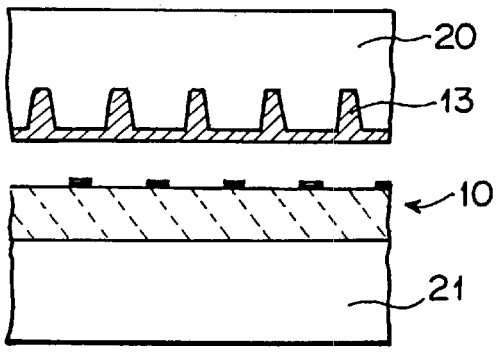

After the press-molding step, the mold 20 is lifted up and separated from the table 21 so that the green sheet 13 thus press-molded is kept in adhesive contact with the mold 20 as shown in FIG. 4C. The green sheet to which the polymer film is attached may be used or the green sheet from which the polymer film is exfoliated may be used alone until this step. Further, the green sheet may be cut into a piece of predetermined size and then press-molded. However, mold 20 may be beforehand designed so that the green sheet is automatically punched to obtain a piece of predetermined size when the mold 20 is pressed against the green sheet.

Figure 4D:
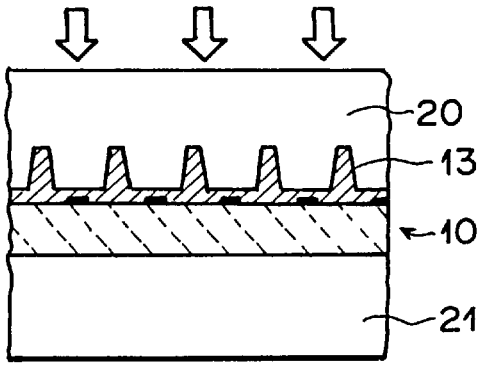

Subsequently, substrate 10 is put and positioned on the table 21. FIG. 4C shows this state. As shown in FIG. 4F, the substrate 10 composes of glass substrate 1 and data electrodes 2 formed on the glass substrate 1. Subsequently, the mold 20 having the green sheet 12 is pressed against the substrate 10 under pressure again so that the green sheet 13 press-molded adheres to the substrate 10 (FIG. 4D). Of course, when the polymer film is attached to the green sheet 13, it is peeled from the green sheet 13 before the press step.

Figure 4E:
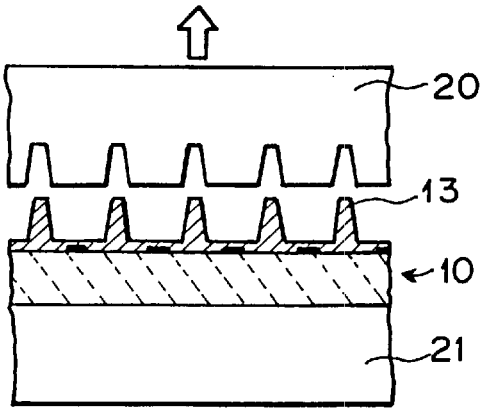
Figure 4F:
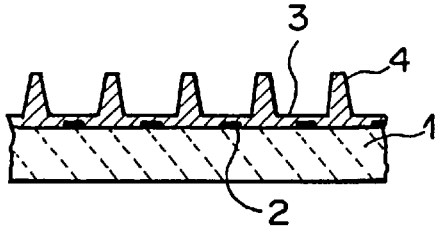

Subsequently, the mold 20 is lifted up and separated to transfer the press-molded green sheet 13 onto the substrate 10 (FIG. 4E). The substrate 10 is baked to decompose and remove organic components such as the binder, and the partition walls 4 and bottom dielectric layer 3 composed of the low melting-point glass and filler which are bound with each other are formed on the substrate 10 (FIG. 4F). The subsequent steps are the same as the conventional method, and phosphor is coated on the resultant substrate and baked to complete a back substrate. The back substrate thus formed and a front substrate are fabricated, sealed, evacuated and filled with discharge gas to complete a panel.

In this embodiment, the thickness of the plate-shaped green sheet is set to 50 $\mu$m. Each recess portion of the mold 20 is designed in a trapezoidal shape so that the narrow portion serving as the bottom portion thereof is set to 45 $\mu$m in width, the wide portion at the surface side is set to 90 $\mu$m in width, the depth of the grooves is set to 150 $\mu$m and the pitch of the grooves is set to 360 $\mu$m. Through the baking step at 550° C., the organic components such as the binder are decomposed, and the volume is contracted by about 20% due to the fusion of the low melting-point glass, so that the partition walls 4 and the bottom dielectric layer 3 are formed. The thickness of the bottom dielectric layer 3 is set to about 15 μm and the height of the partition wall 4 is set to about 120 μm.

The green sheet obtained by the press-molding using the plate-shaped green sheet 12 and mold 20 may be formed by a roll press method instead of the method using the flat type pressure device described above. This embodiment is shown in FIG. 5.

As in the case of FIGS. 4A to 4F, this embodiment uses mold 20 having grooves corresponding to partition wall portions. However, in this embodiment, roll 22 is rotated and horizontally moved relatively to the mold 20 in conformity with the rotational speed. The gap between the roll 22 and mold 20 is firmly kept to be equal to the thickness of the bottom dielectric layer portion. Accordingly, the green sheet 13 is finally press-molded by the roll press while coming into adhesive contact with the mold 20. The subsequent steps are basically the same as FIGS. 4C to 4F. In this process, the green sheet alone may be roll-pressed or it may be roll-pressed while a polymer film is attached thereto. When the green sheet is roll-pressed while the polymer film is attached thereto, the gap between the roll 2 and mold 20 must be adjusted to a suitable value in consideration of the thickness of the polymer film.

This method is mainly different from the method of FIGS. 4A to 4F in that the roll is used. The portion under pressure is made belt-shaped by using the roll, and thus the green sheet can be press-molded with smaller pressure as compared with the case where the press-molding is carried out by using the overall surface of the mold.

Figure 5:
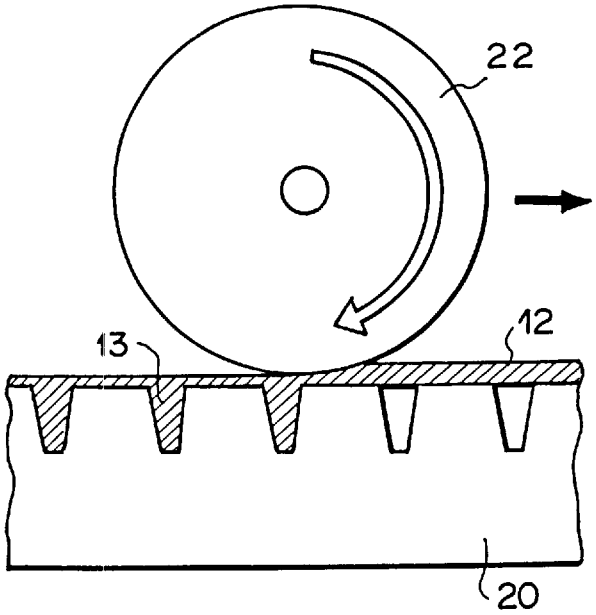
FIG. 5 is a diagram showing another method of manufacturing partition walls according to the first embodiment of the present invention.

In the method of FIG. 5, the extension direction of the grooves serving as the partition walls formed on the mold is set to be parallel to the axial direction of the roll, and the roll is moved while rotated in the arrangement direction of the grooves on the mold. However, the roll may be disposed so that the extension direction of the grooves is perpendicular to the axial direction of the roll and moved while the roll is rotated in the extension direction of the grooves of the mold. Further, the extension direction of the grooves of the mold is not necessarily required to be parallel or perpendicular to the axial direction of the roll, and the extension direction of the grooves and the axial direction of the roll may be set at a suitable bias angle to enhance the embedding of the green sheet into the grooves and suppress occurrence of defects.

Figure 6A:
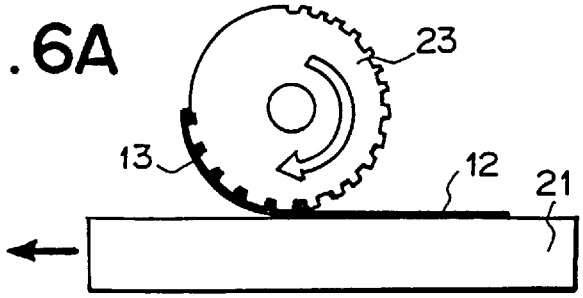
FIGS. 6A to 6C are diagrams showing the other method of manufacturing partition walls according to the first embodiment of the present invention.
Figure 6B:
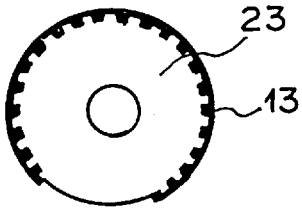
Figure 6C:
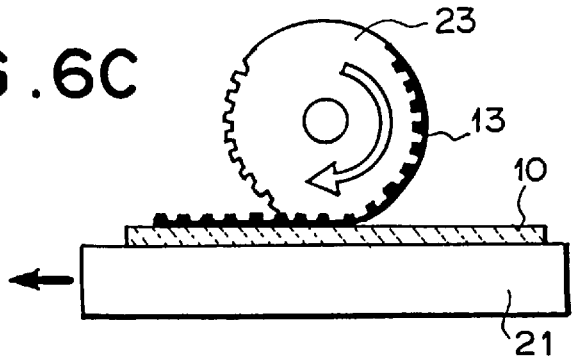

FIGS. 6A to 6C show another method using a roll-shaped mold.

A plate-shaped green sheet 12 is set on table 21 and roll-shaped mold 23 is pressed against the plate-shaped green sheet 12 while being rotated. The table 21 is horizontally moved in conformity with the rotational speed of the roll-shaped mold 23 (FIG. 6A). The roll-shaped mold 23 is designed to have grooves serving as partition wall portions thereon. The gap between the roll-shaped mold 23 and table 21 is adjusted with high precision. The overall plate-shaped green sheet 12 is press-molded to form press-molded green sheet 13 comprising a partition wall portion and a bottom dielectric layer portion while the green sheet 13 is attached to the roll-shaped mold 23 (FIG. 6A).

Since all the partition walls of one panel are formed on the periphery of the roll, a roll-shaped mold having a large diameter on which all the partition wall grooves are formed is used to manufacture partition walls for a large-screen panel. Subsequently, substrate 10 is set and positioned on table 21, and then the roll-shaped mold 23 is rotated, whereby the green sheet 13 press-molded is transferred onto the surface of the substrate 10 (FIG. 6C). FIGS. 6A to 6C shows a case where the axial direction of the roll-shaped mold is set to be parallel to the extension direction of the grooves serving as the partition walls. However, the grooves may be formed along the peripheral direction of the roll-shaped mold. In FIG. 6A, the flat type table 21 is used as a counter (support) mold for the roll-shaped mold 23, however, it may be designed in a roll shape. However, in this case, it is necessary that the press-molded green sheet is attached to the roll-shaped mold 23.

In the above-mentioned embodiment, the basic methods of manufacturing the partition walls and the bottom dielectric layer which is integrally formed with the partition walls is described. A first common feature among the above methods resides in that the plate-shaped green sheet is used. As compared with the method of directly coating the paste on the substrate, the method of forming the plate-shaped green sheet is more excellent in controllability and uniformity of thickness, and also more excellent in productivity because the green sheet can be continuously coated and dried on an elongated polymer film. In this embodiment, the thickness of the green sheet is set to 50 μm, however, the thickness distribution in the green sheet can be easily set to about 1 μm.

Further, a second common feature among the above methods of the first embodiment resides in that the green sheet is not press-molded after it is attached onto the substrate, but the green sheet is directly press-molded.

Figure 10:
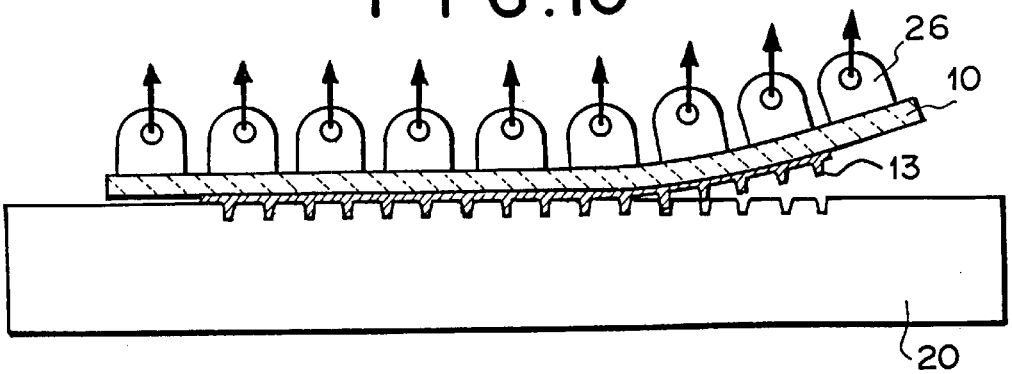
FIG. 10 is a diagram showing a step of separating a mold from a substrate according to a fourth embodiment of the present invention.

In addition to the effect of achieving the uniform thickness of the plate-shaped green sheet as described above, the mechanical precision between the mold and the table or between the roll and the mold can be increased, and it is unnecessary to pay attention to cracks of the glass substrate which are liable to occur in the conventional method of FIG. 10, and damages of the mold due to the cracks because only the green sheet is pressed, so that the press-molding step can be performed by using large press force. Accordingly, the press-molding can be applied to materials having lower fluidity as compared with the conventional methods. The conventional methods use a large amount of fluid resin and thus the step of hardening the resin while press-molding the resin needs long time, resulting in lowering of productivity. However, according to this embodiment, extremely short press-molding time is realized.

Figure 3A:
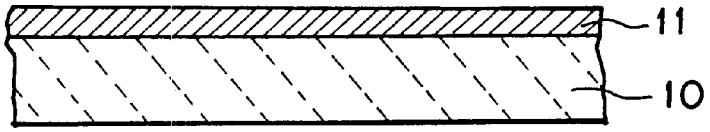
FIG.3A (PRIOR ART)
FIGS. 3A to 3C are diagrams showing another conventional method of manufacturing partition walls.
Figure 3B:
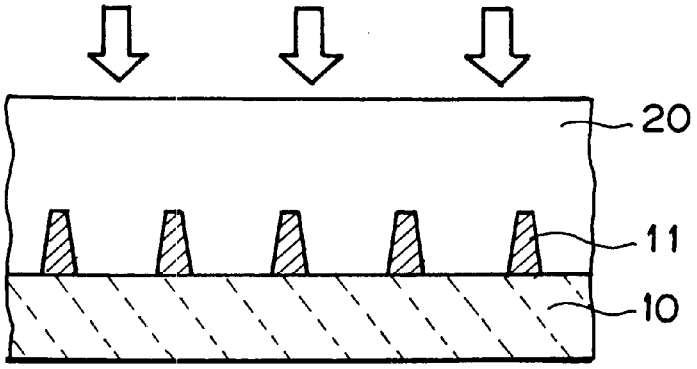
FIG.3B (PRIOR ART)
Figure 3C:
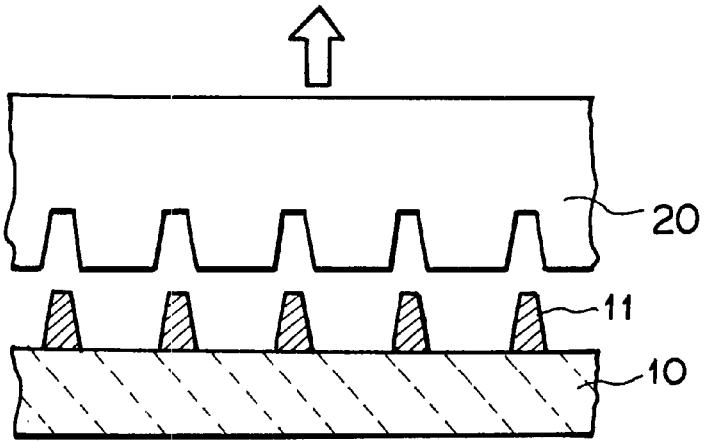
FIG.3C (PRIOR ART)

The green sheet may be added with thermoplastic resin components and the press-molding may be carried out while the mold, the table and the roll are heated up to about 80° C. In this case, the green sheet may be more easily molded to have the same shape as the mold. The shape of the press-molded green sheet is coincident with the shape of the recess portions formed on the mold, and the thickness of the portion serving as the bottom dielectric layer is very uniform. In the conventional method in which the substrate is also sandwiched in the pressure device, according conventional method shown in FIGS. 3A to 3C, the unevenness in the thickness of the substrate directly affects the press-molding shape. Accordingly, the thickness of the bottom dielectric layer is reduced at a site where the thickness of the substrate is large. Conversely, the thickness of the bottom dielectric layer is increased at a site where the thickness of the substrate is small, and the partition wall-forming member does not reach the tip portion of the partition wall, resulting in occurrence of defects. The unevenness in thickness of a glass substrate which is generally used as a substrate is equal to about several tens μm. If this unevenness of the thickness is not permitted, a polishing treatment or a special press method must be used. However, according to the present invention, the green sheet or the green sheet to which a thin polymer film having no evenness in thickness is attached is directly press-molded, and thus the above disadvantage never occurs. The mold, the table and the roll used to press-mold the green sheet are formed of metal or ceramic materials. Particularly, durability and high-precision groove processing are required to the mold, and thus it is preferable that the mold is formed of metal having high hardness or hard metal surface processing to be used chromium plating or the like may be carried out on the mold.

A third common feature among the above methods resides in that the green sheet press-molded has not only the partition wall portion, but also the bottom dielectric layer portion which is integrally formed with the partition wall portion. The bottom dielectric layer is not necessary required in terms of the display operation of the color plasma display panel. However, it serves as a buffer when the green sheet is press-molded, and also the contact area to the substrate is larger as compared with the method of transferring only the belt-shaped partition wall portion onto the substrate because the bottom dielectric layer and the partition wall portion are integrally formed as an integral sheet-shaped structure. Therefore, the transfer step can be performed with no occurrence of defects in the partition wall portion. Further, the adhesion surface may be easily processed with adhesive or solvent to surely perform the transfer step. In order to meet these purposes, the thickness of the bottom dielectric layer portion after the press-molding is preferably larger. However, since the increase of the thickness affects the writing characteristic of the plasma display panel, and thus the thickness of the bottom dielectric layer portion is preferably set to any value in the range from 5 $\mu$m to 100 $\mu$m. In this embodiment, the thickness is set to about 20 $\mu$m.

A fourth common feature among the above methods resides in that the press-molded green sheet comprising the partition wall portion and bottom dielectric layer portion is kept to adhere to the mold and the green sheet is directly transferred to the substrate under the adhesion state. With the conventional method of treating the press-molded green sheet alone which is discharged from the mold and positioning the green sheet to the substrate for adhesion, the green sheet is liable to be cracked or broken because it is extremely thin and thus fragile. Further, the positioning work to the substrate is difficult and it is not easy to press the green sheet without breaking the partition wall portion formed when the green sheet adheres to the substrate. According to the present invention, the green sheet press-molded is treated while attached to the mold irrespective of the shape (flat type or roll type) of the mold, and thus the above disadvantages don't occur.

The adhesion of the press-molded green sheet to the mold can be implemented by enhancing the adhesion force between the mold and the press-molded green sheet relatively to the adhesion force between the flat table or flat roll and the press-molded green sheet. The difference in adhesion force can be achieved by increasing the contact area between the press-molded green sheet and the surface of the mold or performing a surface roughness treatment on the surface of the mold or a surface treatment using mold-separating agent.

With the above features, the partition walls can be formed with high dimensional precision, by stable steps and in a short manufacturing time.

(Second Embodiment)

Next, an improved method for each step to manufacture partition walls in which defectives occur more hardly in the manufacturing method of the present invention will be described. The second embodiment relates to a method of performing the press step under a vacuum or pressure-reduced state and a device therefor.

The plate-shaped green sheet has airtightness, and thus bubbles may remain between the mold and the green sheet or between the table and the green sheet when the press-molding step is carried out. Particularly when large-area and high-aspect partition walls are formed by using the flat type mold as shown in FIGS. 4A to 4E, bubbles are liable to be trapped. This causes a defective portion, or partially attaches the press-molded green sheet to the table to produce defectives when the mold and the table are separated from each other.

Figure 7:
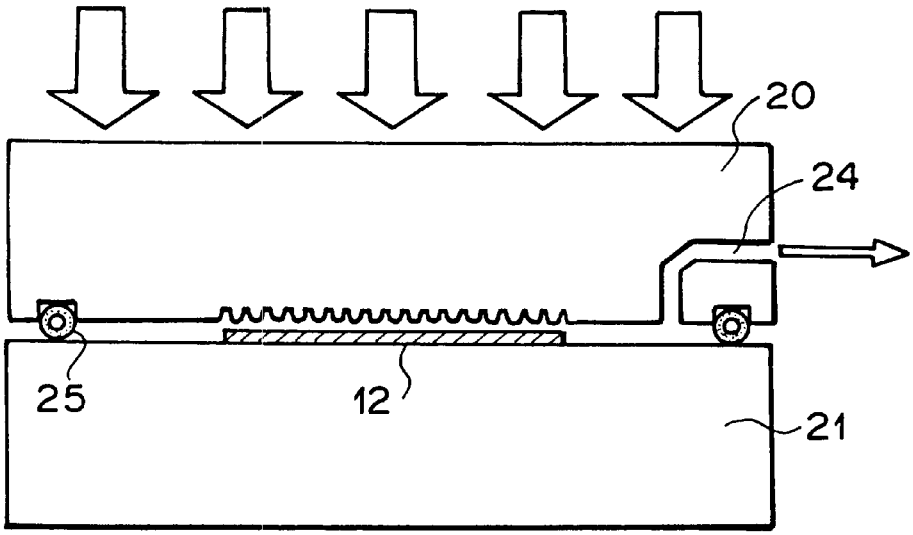
FIG. 7 is a diagram showing a method of pressure-forming a green sheet according to a second embodiment of the present invention.

An embodiment shown in FIG. 7 aims to solve the above disadvantage, and the press-molding step is carried out while the gap between the mold 20 and the table 21 is evacuated and kept under vacuum. Various press devices each having an evacuating function may be used to implement this method. For example, exhaust opening 24 is formed in the mold 20, and rubber seal 25 is provided to the peripheral portion of the mold 20 as shown in FIG. 7. By pressing down the mold 20, the seal 25 is brought into close contact with the mold 20 and the table 21. A vacuum pump is connected to the exhaust opening 24, and starts its exhaust operation. The exhaust volume is very small and thus the inside is exhausted in a short time. Subsequently, the mold is pressed down to a predetermined position to press the green sheet, thereby forming a press-molded green sheet having no defective.

Figure 8:
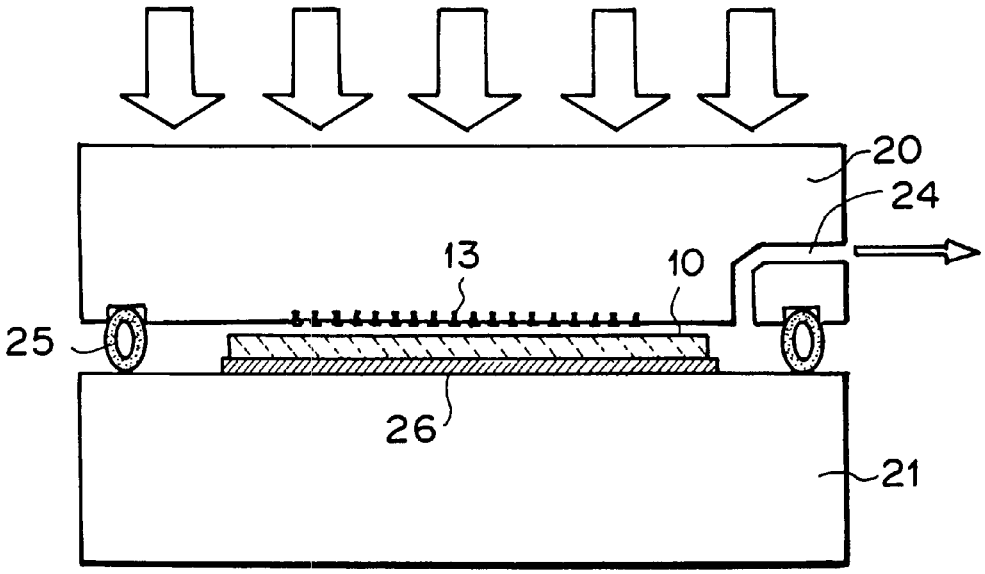
FIG. 8 is a diagram showing pressure-adhesion to a substrate according to the second embodiment of the present invention.

When the press-molded green sheet is transferred onto the substrate, bubbles may occur between the substrate and the green sheet. The bubbles cause failure of transference of the green sheet to the substrate and reduction in adhesiveness between the green sheet and the substrate, so that the press-molded green sheet may be deformed in the baking step. The method of attaching the press-molded green sheet to the substrate under vacuum-evacuated state as described above is effective to the above case. As shown in FIG. 8, the device construction is substantially the same construction as shown in FIG. 7. That is, exhaust opening 24 is formed in the mold 20, and a rubber seal 25 is provided to the peripheral portion of the mold 20. When the mold 20 is pressed down, the seal 25 is brought into close contact with the mold 20 and the table 21. A vacuum pump is connected to the exhaust opening 24 and starts its exhaust operation. The exhaust volume is very small and thus the inside sealed is exhausted in a short time. Subsequently, the mold 20 is further pressed down to a predetermined position to press the press-molded green sheet 13, thereby bringing the press-molded green sheet 13 into close contact with the substrate 10. When the substrate 10 has unevenness in thickness, the substrate 10 is preferably pressed by hydrostatic pressure in order to more perfectly bring the press-molded green sheet into close contact with the substrate 10. Various methods may be used to apply hydrostatic pressure, and insertion of a rubber sheet 26 in the gap between the table 21 and the substrate 10 is adopted as the simplest method, whereby the close contact between the press-molded green sheet 13 and the substrate 10 can be perfectly performed. Of course, the hydrostatic pressure is effective even when no vacuum-evacuation is carried out.

(Third Embodiment)

According to a third embodiment, in order to make easier the transfer of the press-molded green sheet to the substrate, a substrate on which a backside dielectric layer serving as a backside insulating layer is formed in advance is used to enhance the adhesion force between the press-molded green sheet and the substrate.

FIGS. 9A to 9D are diagrams showing this embodiment to meet this purpose.

Figure 9A:
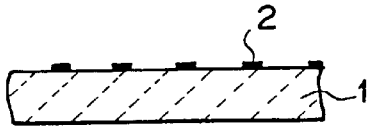
FIGS. 9A to 9D are diagrams showing a method of manufacturing partition walls according to a third embodiment of the present invention.
Figure 9B:
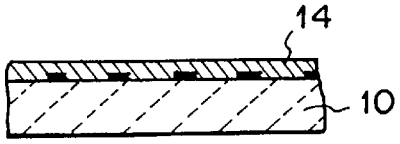
Figure 9C:
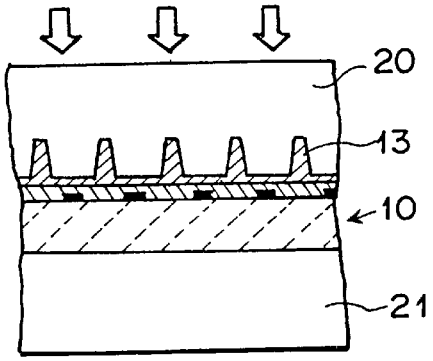
Figure 9D:
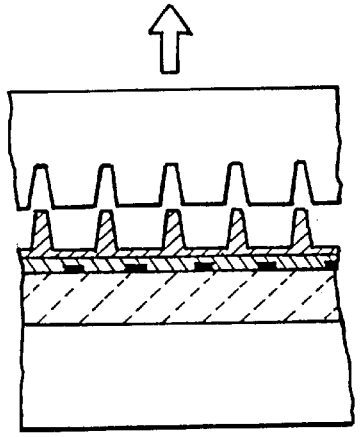

Data electrodes 2 are formed on glass substrate 1 (FIG. 9A), and then a thin member serving as backside dielectric layer 14 is formed on the surface to form substrate 10 (FIG. 9B). The member of the backside dielectric layer 14 is formed of low melting-point glass, filler, binder, and the like. It may be formed of the same material as the green sheet member serving as the partition walls and the bottom dielectric layer, however, it may contain no filler or a small amount of filler so as to obtain a minute backside dielectric layer after the baking step. Further, the resin component of the binder may be different from that of the green sheet member, and any material composition may be used insofar as it firmly adheres to glass. The backside dielectric layer 14 may be formed by a screen-print drying method, or after a green sheet is formed, the backside dielectric layer 14 may be laminated on the surface of the green sheet.

The backside dielectric layer 14 is used to improve the adhesiveness and thus it is not required to increase the thickness of the backside dielectric layer 14. Therefore, in this embodiment, the thickness of the backside dielectric layer 14 is set to about 7 $\mu$m.

Subsequently, the mold 20 having the green sheet 13 is pressed against the substrate 10 under pressure again so that the green sheet 13 press-molded adheres to the substrate 10 (FIG. 6C).

Subsequently, the mold 20 is lifted up and separated to transfer the press-molded green sheet 13 onto the substrate 10 (FIG. 6D).

Since the dielectric layer 14 is formed on the surface of the substrate 10 as described above, the substrate 10 smoothly conforms to the press-molded green sheet 13 through the backside dielectric layer 14, and the unevenness of the surface of the backside dielectric layer 14 has an effect on the adhesiveness. Of course, the heating when the press-molded green sheet 13 adheres to the substrate 10 under press is effective to the improvement of the adhesive strength. Further, solvent for dissolving organic components such as binder is coated at a small thickness on the surface of the backside dielectric layer or the surface of the press-molded green sheet before the adhesion step, and then the substrate and the press-molded green sheet are quickly pressed against each other so that the press-molded green sheet adheres to the substrate, whereby both the binders of the green sheet and the backside dielectric layer are dissolved together and join each other, thereby obtaining intensive adhesive strength.

According to the above method, the backside dielectric layer is subjected to only the dry treatment, and the press-molded green sheet is adhesively attached to the substrate under the state that binder resin exists. However, the backside dielectric layer may be once baked and set as a substrate. In this case, it is importable to make the backside dielectric layer porous and uneven. This is satisfied by baking the backside dielectric layer at a temperature at which the backside dielectric layer is fixed, but is not reflowed, or increasing as a component of the backside dielectric layer the amount of a filler component which is not melted at the baking temperature.

(Fourth Embodiment)

Next, a fourth embodiment for the step of peeling the press-molded green sheet from the mold after the adhesion step of the press-molded green sheet and mold will be described.

In the case of the roll type mold as shown in FIGS. 6A to 6C, the step of separating the press-molded green sheet from the mold is relatively easily performed. However, the step of separating the press-molded green sheet from the flat type mold is more difficult as the substrate is for a panel having a larger screen and higher precision. In general, the separation step is carried out by moving the mold vertically while keeping the substrate on the table under vacuum-suction. However, when the substrate has a large area and a short partition-wall pitch, the contact surface area between the press-molded green sheet and mold is large and thus large force is needed to perform the separation work. Further, the separation between the press-molded green sheet and mold is not partially performed, and thus a defective portion is liable to occur.

FIG. 10 shows an embodiment for performing the separation work by using elasticity of the substrate. The mold used in this embodiment is preferably formed of a non-deformative material having high rigidity such as metal or the like. Therefore, use of the elasticity of the substrate itself is effective to the separation of the substrate from the mold. That is, the separation work is carried out with small force by pulling the substrate from one side thereof and separating the substrate from the mold as if turning over the substrate.

FIG. 10 shows a method of separating the substrate 10 from the mold by using its elasticity deformation. As shown in FIG. 10, the substrate 10 is peeled off from the mold 20 as if the substrate 10 is turned over by using plural divided vacuum-suction jigs 26, or by using an elastic vacuum-suction table, the substrate 10 is peeled off from the mold 20 while curling the substrate 10 together with the table. A glass plate of about 3 mm or less in thickness is ordinarily used as the substrate 10, and it can be sufficiently elastic deformed with no crack to the extent that the separation work can be easily performed. In order to making the understanding easy, the substrate 10 is illustrated as being separated in the arrangement direction of the partition walls in FIG. 10. However, it is preferable that the substrate 10 is separated in the direction perpendicular to the arrangement direction of the partition walls, that is, in the extension direction of the partition walls because the occurrence of defectives can be suppressed.

As described above, according to the present invention, the partition walls can be formed stably and in a short time, and the consumption amount of materials can be reduced, so that the cost can be reduced. Further, the dimension precision of the partition walls and the bottom insulating layer is high, and they can be uniformly manufactured on a large-area substrate. Therefore, the driving margin of the panel can be improved. Further, the precision can be enhanced and the aspect of partition walls can be also increased, so that panels having high light emission efficiency and high resolution can be manufactured.

In this specification, only the belt-shaped partition walls are described. However, according to the method of the present invention, grid-type partition walls or partition walls having more complicated shapes may be manufactured by using a mold.

What is claimed is:

1. A display panel manufacturing method comprises: a step of sandwiching a plate-shaped partition wall-forming member between a mold having an inverted shape to partition walls and a support mold, and press-molding the partition wall-forming member to form a partition wall member comprising partition wall portions and a bottom insulating layer portion in close contact with the mold; and a step of transferring the partition wall member onto a display substrate.

2. The display panel manufacturing method as claimed in claim 1, wherein said mold is of a flat type.

3. The display panel manufacturing method as claimed in claim 1, wherein said mold is of a flat type, and said support mold is of a roll type.

4. The display panel manufacturing method as claimed in claim 1, wherein said mold is of a roll type.

5. The display panel manufacturing method as claimed in claim 1, wherein the space between said mold and said support mold is subjected to exhaust-treatment when said plate-shaped partition wall-forming member is press-molded.

6. The display panel manufacturing method as claimed in claim 1, wherein when the press-molded partition wall member which is brought into close contact with said mold is transferred onto said display substrate, the space between said partition wall member and said display substrate is subjected to exhaust-treatment.

7. The display panel manufacturing method as claimed in claim 1, wherein a backside insulating layer is provided on said display substrate onto which the press-molded partition wall member is transferred.

8. The display panel manufacturing method as claimed in claim 1, wherein said display substrate with which the press-molded partition wall member is brought into close contact is separated from said mold by using elastic deformation of said display substrate as if said display substrate is turned over from one end thereof.

9. The display panel manufacturing method as claimed in claim 1, wherein said display panel is a plasma display panel.

* * * * *